US006231638B1

(12) United States Patent
Janz et al.

(10) Patent No.: US 6,231,638 B1
(45) Date of Patent: May 15, 2001

(54) PROCESS FOR PRODUCING METAL FROM METAL ORES

(75) Inventors: Joachim Janz, Oyten; Manfred Voss, Breman, both of (DE)

(73) Assignee: Der Grune Punkt - DSD Duales System Deutschland AG, Köln (DE)

( * ) Notice: Subject to any disclaimer, the term of this patent is extended or adjusted under 35 U.S.C. 154(b) by 0 days.

(21) Appl. No.: 09/245,926

(22) Filed: Feb. 8, 1999

(30) Foreign Application Priority Data

Dec. 22, 1998 (DE) ..... 198 59 354

(51) Int. Cl.[7] ..... C21C 5/30

(52) U.S. Cl. ..... 75/378; 75/387; 75/460; 75/469; 75/491

(58) Field of Search ..... 75/387, 460, 469, 75/491, 378

(56) References Cited

U.S. PATENT DOCUMENTS 5,244,490 * 9/1993 Agarwal ..... 75/500
5,554,207 * 9/1996 Bogdan et al. ..... 75/500
5,772,727 * 6/1998 De Haas et al. ..... 75/378

FOREIGN PATENT DOCUMENTS 27 14 355 10/1978 (DE) .
0 059 904 9/1982 (EP) .
0 622 465 11/1994 (EP) .
597770 5/1925 (FR) .
61-153218 7/1986 (JP) .
6-335628 12/1994 (JP) .

* cited by examiner

*Primary Examiner*—Roy King
*Assistant Examiner*—Tima McGuthry-Banks
(74) *Attorney, Agent, or Firm*—Venable; George H. Spencer; Robert Kinberg

(57) ABSTRACT

The invention concerns a process for producing metal from metal ores, in particular crude or pig iron from iron ore, wherein the ore which contains metal oxides is brought into contact with a reducing gas which contains carbon and/or hydrogen from solid, carbon-bearing and/or hydrocarbon-bearing substances obtained at least partially from plastic waste. According to the invention, the carbon-bearing and/or hydrocarbon-bearing substances are injected in comminuted fluidized form as an agglomerate into the air flow in the hearth of the metallurgical shaft or pit furnace, in particular a blast furnace. The apparatus includes a first shut-off device that is closed when blockages of the plastic material occur in the transport conduit or the lance, a second shut-off device that is closed when hot air penetrates into the transport conduit and/or the lance by reverse flow, and a third shut-off device that is closed when compressed air is supplied to a lance for cooling.

13 Claims, 4 Drawing Sheets

PROCESS FOR PRODUCING METAL FROM METAL ORES

CROSS-REFERENCE TO RELATED APPLICATION

This application claims the priority of Patent Application No. 19859354.6 filed on Dec. 22, 1998 in Germany, the subject matter of which is incorporated herein by reference.

FIELD OF THE INVENTION

The Invention concerns a process and an apparatus for producing metal from metal ores, in particular crude or pig iron from iron ore, in which the ore which contains metal oxides is brought into reaction contact with a reducing gas which contains carbon and/or hydrogen (and possibly compounds thereof) and which was previously obtained from solid, carbon-bearing and/or hydrocarbon-bearing substances.

BACKGROUND OF THE INVENTION

It is known that the ore which for the major part comprises metal oxides (being various ones, even in the case of iron) must be subjected to a reduction procedure before the metal can be obtained. That reduction operation is effected by means of carbon and possibly hydrogen—or also compounds thereof—which are contained in a reducing gas which is caused to act on the metal ore.

The reduced metal ore then passes into a smelting procedure. In that case, the gas required for the reduction operation is obtained in the region of the reducing and smelting procedure itself, by carbon-bearing substances (for example coke, coal, oil, natural gas) being added to the zone of the metal which has already been reduced and heated, whereby, with the addition of oxygen (in the air), they are broken up or converted in carbon-bearing gas which is fed to the preceding reduction operation.

The conventional blast furnace process is known in that respect, in which both reduction of the metal ore and also formation of the reducing gas as well as subsequent smelting liquifaction of the metal occur in the blast furnace—progressively in a downward direction. In that blast furnace process, among additive substances, coke is possibly mixed with the iron ore, as a carbon carrier. It is known for oil or carbon also to be injected by way of lances into the air flow in the region of the hearth of the blast furnace for better control of the blast furnace process and to save on coke, the consumption of coke thereby also being reduced. This material (oil or coal dust) which is additionally injected must be introduced in very finely distributed form in order to ensure clean adequate gasification. Two articles in the journal "Stahl and Eisen", No 4 of Feb. 25, 1985, pages 211–220 contain summaries relating to the injection of coal dust into blast furnaces. The injection of coal dust was forced upon operators in particular in the course of rising oil prices. In that respect it was found that when adopting the injection procedure, because of the short time available of about 10 ms, good results, more specifically almost complete gasification of the coal dust, were achieved only with grain sizes of below 0.1 mm., even if tests were also successfully carried out with some installations, using larger grain sizes.

It has also already been proposed that, instead of injecting oil and coal dust, other carbon-bearing waste substances such as, for example, dried sewage sludge or other carbon-bearing waste such as refuse, waste paper, lignite, as well as waste from wood, plastic material, rubber or the like can be introduced (DE-A 29 35 544). In regard to appropriate tests or results however, all that was put forward were assumptions as to the manner in which such substances are to be introduced into the blast furnace. DE-A 41 04 252 also proposes introducing plastic-bearing waste substances into a blast furnace in a fine-grain or dust form by way of the tuyères, with the introduction of sewage sludge (dust capable of trickle flow) being referred to by way of example. It is expressly emphasized that this process also requires that the substance, which is to be injected, be of a fine-grain nature.

SUMMARY OF THE INVENTION

Taking the known process as set forth in the opening part of this specification as its basic starting point, the object of the invention is to make plastic waste, including in organically and/or inorganically contaminated form, useable as a supply for the constituents of the reducing gas. Plastic waste occurs constantly in large amounts and represents a serious disposal problem. It occurs mostly if not exclusively in solid form, either as packaging waste—which is frequently heavily contaminated—or as offcuts or the like in the course of the production of plastic articles.

Accordingly the invention provides that the carbon-bearing and/or hydrocarbon-bearing substances, at least partially comprising plastic material, which in the process of the general kind set forth in the opening part of this specification are supplied to obtain the reducing gas, are injected in comminuted fluidised form as an agglomerate into the air flow in the hearth of the metallurgical shaft or pit furnace, in particular a blast furnace. That is effected by way of lances which project into the shaft furnace and which are connected to a transport conduit. The plastic material to be injected is fed to the lances by way of that transport conduit. In the event that, contrary to expectation, blockages should occur or hot air should blow back out of the blast furnace into the lance and thus into the transport conduit, a plurality of shut-off or check devices are proposed in the transport conduit, so that the transport conduit is not only protected but immediate resumption of overall operation of the installation and injection of the plastic materials occurs. To dissolve blockages of the plastic material in the transport conduit, there are provided a first and third shut-off device, while a second shut-off device is provided to prevent reverse transportation of plastic material or blow-back of the hot gas masses from the blast furnace into the transport conduit. The mode of operation thereof is set forth in greater detail in the claims but in particular also in the specific description.

To dissolve blockages in the transport conduit, the invention makes use of the fact that the pressure in the transport conduit is a pressure which is 4 to 6 times atmospheric pressure. If therefore the pressure in the interior of the transport conduit is reduced to atmospheric pressure (about 1 bar) by way of a vent opening, a very great pressure and suction effect is applied to the blockages which are released and conveyed out of the system from the transport conduit.

So that the injection lances which project into the blast furnace do not overheat when the injection installation in a stopped condition, there is provided a connection for compressed air which is always activated.

Further advantageous configurations of the invention are set forth in the claims.

BRIEF DESCRIPTION OF THE DRAWINGS

The invention is described in greater detail hereinafter by means of an embodiment by way of example with reference to the accompanying drawings in which.

DETAILED DESCRIPTION OF THE INVENTION

Figure 1:
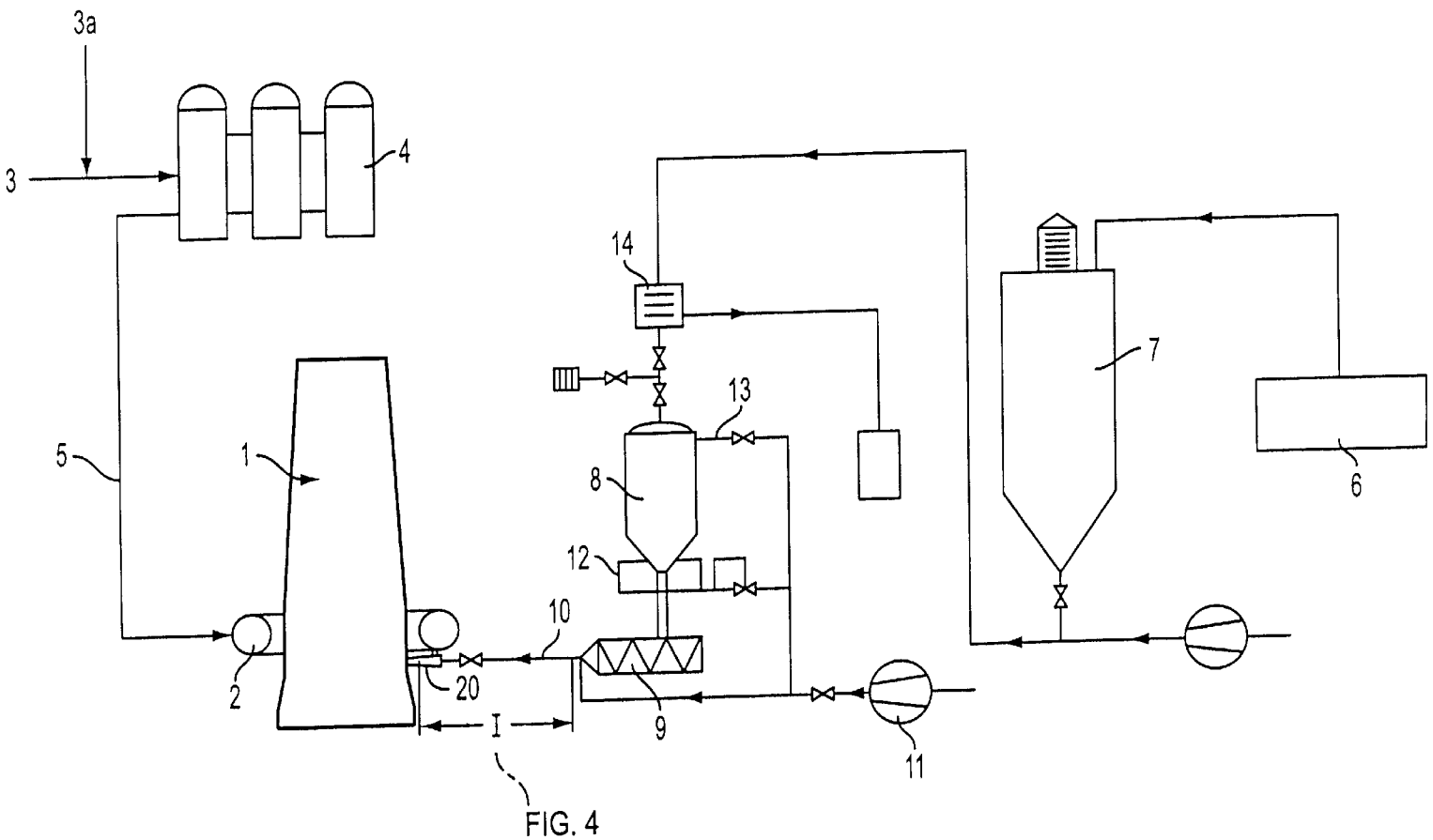
FIG. 1 is a diagrammatic view of a blast furnace including the appropriate devices for the feed of fluidised plastic material and including the appropriate devices for the feed of a heated air flow.
Figure 3:
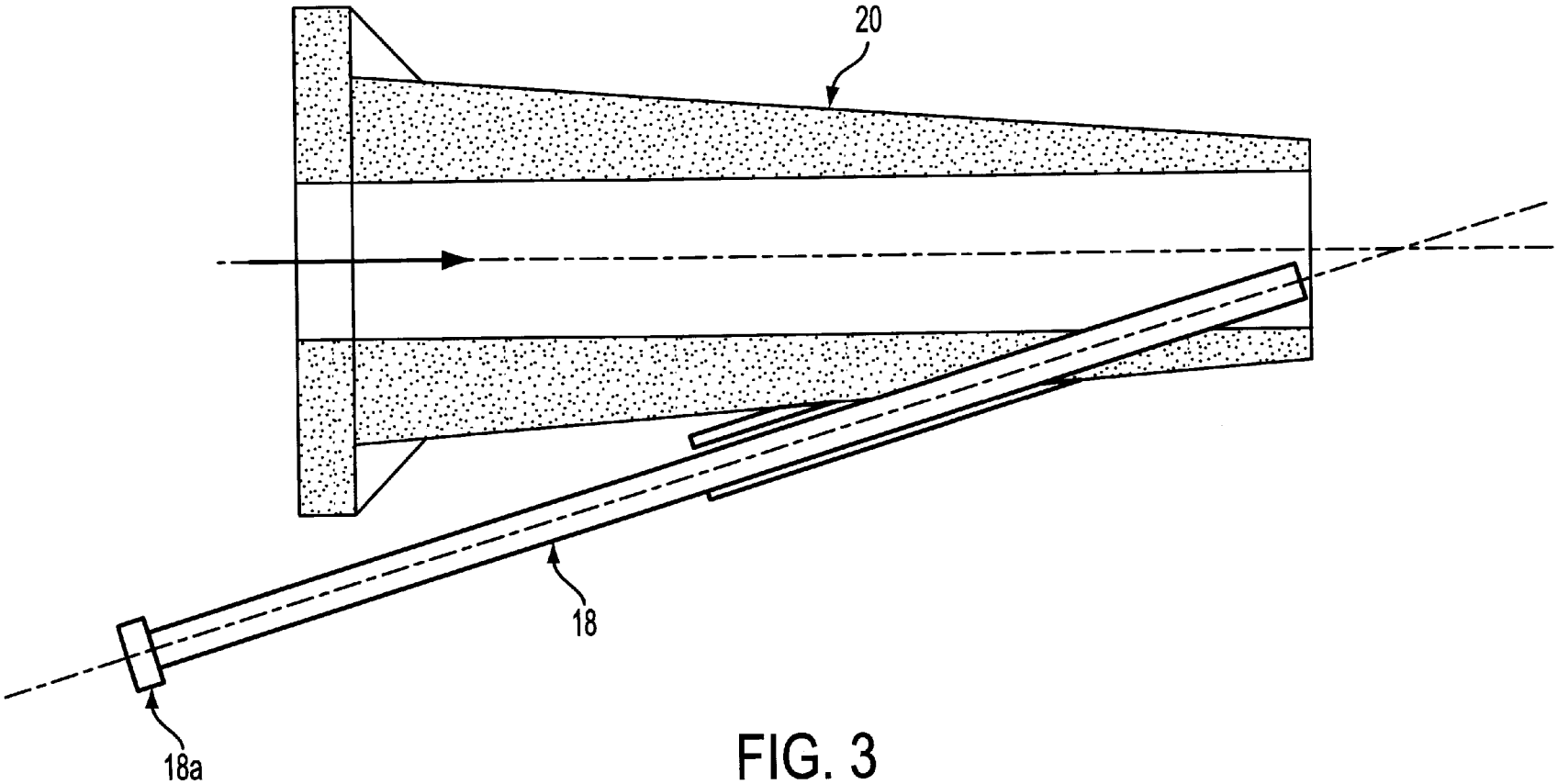
FIG. 3 shows a nozzle-lance arrangement for the injection of fluidised plastic material into the tuyeres or nozzles of a blast furnace.

Referring to FIG. 1. shown therein is a blast furnace 1 which is of the usual structure and which in the lower hearth region has a plurality of nozzles or tuyères 20 (see FIG. 3) which are distributed uniformly around the periphery and to which air 3 heated in an air heater 4 is fed by way of a conduit 5 and a ring conduit or manifold 2. In addition the air 3 can also be enriched with oxygen 3*a* ($O_2$). For the sake of simplicity, only one nozzle 20 is indicated in FIG. 1.

Some or all of the nozzles 20 have one or more lances 18, by way of which the additional fuel can be injected. In the previously known blast furnaces, the additional fuel was either coal dust or oil, whereby it was possible to achieve an improved operating performance for the blast furnace 1 and a saving on coke. The usual number of nozzles 20 of the tuyère arrangement is for example 32 and each nozzle is of a diameter of for example 140 mm. In regard to the feed of coal dust or oil, there are usually two lances which are of a diameter of typically 12 or 8 mm. In the present case there is in each nozzle 20 only one lance 18 for the feed of fluidised plastic material, and it is for example of a diameter of 28 mm.

In the tuyère arrangement, either all lances 18 can be supplied with fluidised plastic material, or the nozzles 20 are equipped in a mixed or hybrid fashion, that is to say some nozzles have for example two oil lances while other nozzles 20 are in turn equipped with a plastic material lance 18. It is however desirable for the distribution of plastic material lances 18 and oil lances to be uniform around the periphery of the tuyère arrangement.

In the present embodiment preparation and processing of the plastic material is effected in the following manner:

From a plastic material preparation installation 6, comminuted plastic material is fed to a silo 7, in the form of an agglomerate of high specific surface area and with a grain size of 1 to 10 mm, preferably about 5 mm. The use of plastic material which results in an agglomerate with a bulk density of greater than 0.35 has proved itself worthwhile. Plastic material packaging cartons or the like are suitable for these purposes while for example plastic films or sheets, upon comminution thereof, result in a lower bulk density, so that special precautions must be taken prior to or upon injection, in order to be able to inject an adequate quantity.

FIG. 1 shows an injection vessel 8 into which the plastic material agglomerate is introduced by way of a course grain sieve 14 and fluidised by the injection of a fluidisation gas by means of a blower 11 by way of conduits 12 and 13. With an injection vessel having a volume for example of 3 $m^3$, about 2 to 25 $m^3$ of fluidisation gas/h is required. The fluidised plastic material is then metered by way of a separate metering device 9, for example a mechanical screw-type metering device or a cell-wheel metering device, and uniformly fed by way of a conduit 10 to the appropriate lances 18 of the tuyère arrangement. In this case, the plastic material particles are conveyed by means of flying flow conveyance, that is to say with a high proportion of gas, for example with a ratio of 5 to 30 kg of plastic material per 1 kg of fluidisation gas. In the present example air under pressure is used as the fluidisation gas as there is no risk of explosion, due to the size of the plastic material particles of from 1 to 10 mm.

The amount of plastic material injected can be varied over wide limits (for example 30–150 kg of plastic material/t pig iron). It was also found that, with equally good gasification, an amount of plastic material in comparison with oil, that is higher by a factor of 1.5, can be injected. If the injection amount of plastic material is above 70 kg/t pig iron, then $O_2$ is preferably added to the air flow for the purposes of good gasification, as already mentioned above. For each kg of plastic material/t pig iron above the value of 70 kg/t pig iron, the air should be enriched with 0.05 to 0.1% $O_2$ preferably 0.08%. For a good gasification effect the mixed air temperature from the air heater 4 is above 1100° C. The injection pressure at the lances 18 is desirably $0.5\times10^5$ to $1.5\times10^5$ Pa above the pressure in the blast furnace 1.

As plastic material melts at relatively high temperatures—in contrast to coal dust or oil—there is the danger of the plastic material suffering from baking-on phenomena before Issuing from the injection lance 18 due to heat being radiated back from the nozzle. For that reason the flow speed of the gas with the plastic material particles in suspension must be sufficiently high, in comparison with the tube cross-section of the lance 18, to prevent the plastic material from starting to melt or fuse on and thus suffer from baking phenomena in the lance 18 due to heat being radiated back. A suitable ratio of the flow speed to the lance cross-section is in the range of 20000 to 40000 l/sec×m, preferably about 25000 l/sec×m. If that ratio is too low, there is the risk of baking phenomena occurring, while if the value is too high, a excessive wear occurs in the lances 18. In addition, in all transport conduits, particularly in the connecting region 18*a* of the lances 18, it is necessary to avoid discontinuities, non-uniformities and constrictions in the flow configuration and radii of smaller than 1 m in the case of bends and curves.

Figure 2:
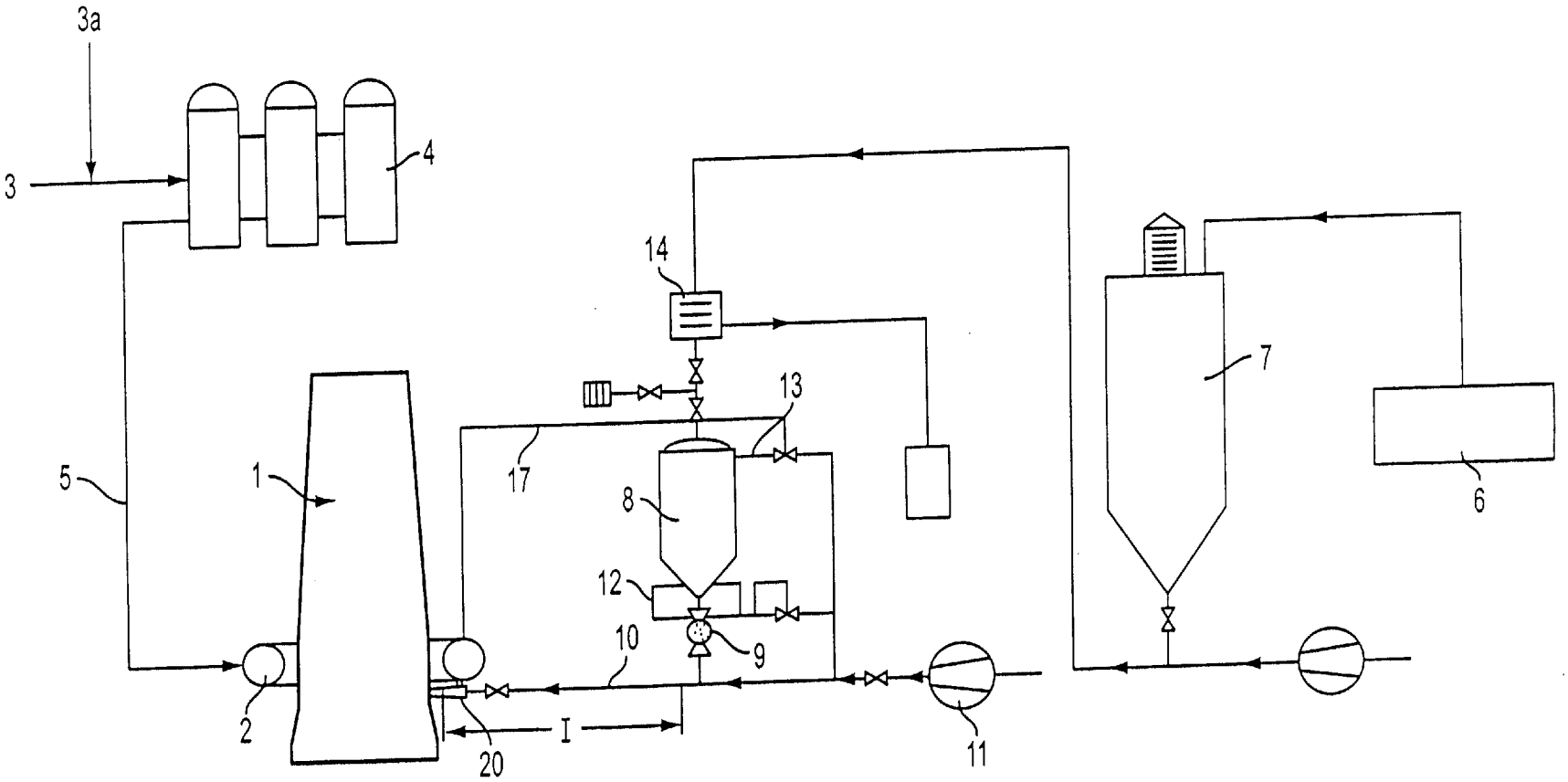
FIG. 2 shows an alternative embodiment.

In the arrangement shown in FIG. 1 the metering effect is implemented by a separate metering device 9. Another construction is shown in FIG. 2 that can provide that fluidisation and metering in one operation. For that purpose a ball valve 19 is provided as the metering device in the lower region of the injection vessel. Fine setting is effected by way of the pressure setting and adjusting the amount of fluidisation gas. That construction however requires fast accurate regulation of the feed of air under pressure at the upper conduit 13 of the injection vessel 8 in dependence on the fluctuating internal pressure in the blast furnace 1. Therefore, at a suitable location in the blast furnace 1 a pressure sensor is provided which rapidly adjusts a valve in the conduit 13 by way of a regulating loop 17 in order to arrive at an accurate metering effect.

Fluidisation and metering of the plastic material particles can also be implemented by means of a pressure-tight cell-wheel lock assembly. In this case the injection vessel 8 can be omitted.

Figure 4:
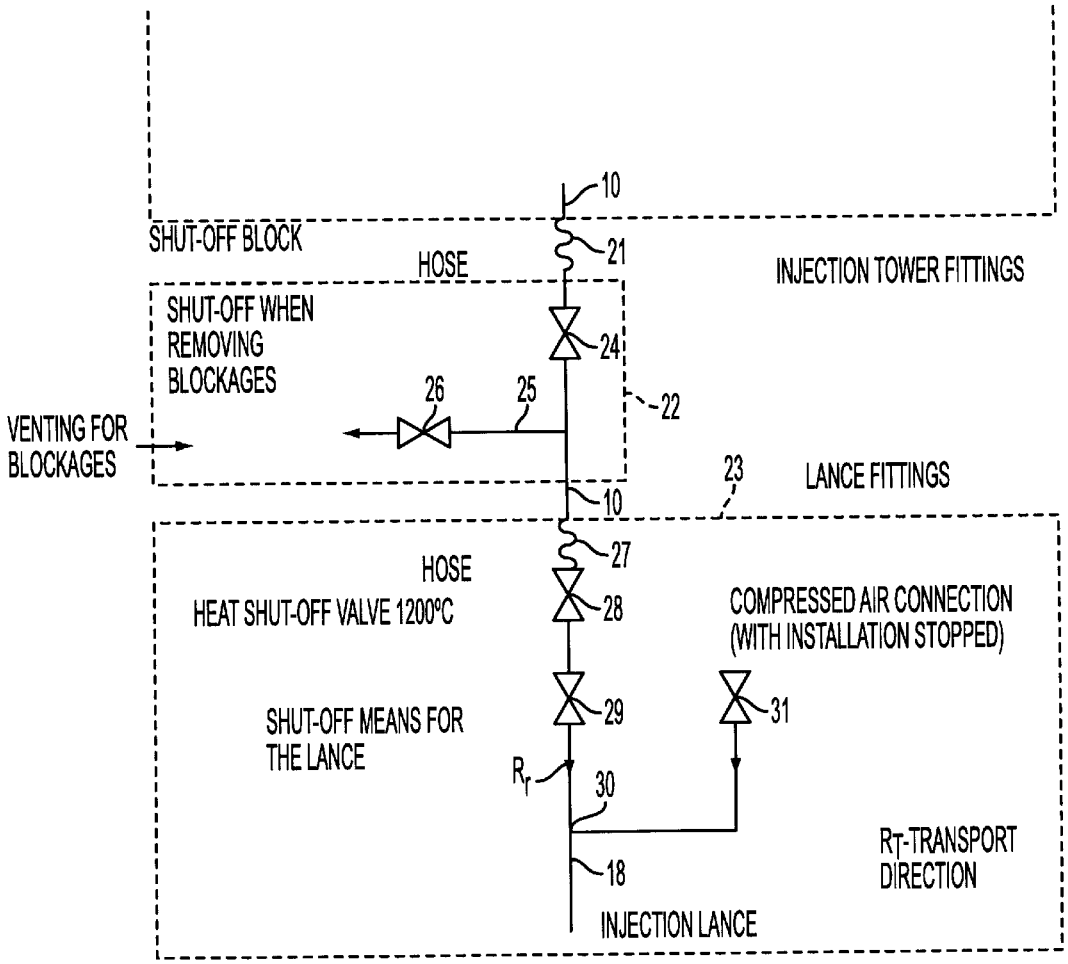
FIG. 4 is a view on an enlarged scale of the transport conduit for transporting the plastic material to the lance.

FIG. 4 is an enlarged view of the portion, indicated at I in FIGS. 1 and 2. of the conduit 10 by way of which the plastic materials to be injected into the blast furnace 1, in particular plastic waste, in agglomerated form, are transported to the lance 18. Adjoining the fittings in the injection tower (including for example the metering device 9 but also for example the connection for the compressed air or the supply for flushing air/nitrogen) that transport conduit 10 is formed by a hose portion 21. Joined thereto is a shut-off block or unit 22 of the transport conduit 10 and joined in turn to the shut-off block or unit 22 in the direction of the injection lance 18 is an essential lance fitting portion 23 including the injection lance 18.

The shut-off block or unit 22 includes as a first shut-off device 24 a shut-off valve which is closed to eliminate blockages (will be referred to hereinafter). In addition, a vent conduit (opening) 25 extends in the shut-off block or unit 22 from the transport conduit 10. The vent conduit (opening) 25 has a shut-off valve 26.

Connected to the shut-off block or unit 22 is the region of the transport conduit 10, which is also referred to hereinafter as the fitting portion 23 of the lance. Disposed within that fitting portion 23 is a hose portion 27 which connects the transport conduit 10 of the shut-off block or unit 22 to a heat shut-off or check valve 28 as a second shut-off device. Joined to that second shut-off device is a third shut-off device 29 for shutting off the lance 18. Disposed downstream of the third shut-off device (as viewed from the shut-off block or unit 22) is a mouth portion 30 by way of which compressed air can be injected by means of a connecting portion 31 into the lance 18 and thus into the blast furnace 1.

The mode of operation of the above-described arrangement is as follows: if for any reason no plastic material or other reducing agent is being injected into the blast furnace, the shut-off device 29 is closed and the connection 31 is opened and compressed air is then blown into the lance, when the injection installation is in a stopped condition. The operation of injecting compressed air is implemented either manually or automatically whenever the transport of plastic materials to the lance is interrupted. The introduction of compressed air prevents the injection lance from heating up to an undesirably high degree, and heat damage is thus precluded. The connection 31 for the introduction of compressed air into the lance is opened whenever the feed of plastic materials to the lance is closed by the third shut-off device. The connecting portion 31 itself essentially comprises a valve which is connected to a compressed air reservoir.

In the event of pressure fluctuations in the tuyère—which may repeatedly and undesirably occur—a return flow of hot tuyère gas from the tuyère (blast furnace) into the lance and the injection system behind same can be prevented, the heat shut-off valve which is in the form of a non-return valve is provided as the second shut-off device. That heat shut-off valve can be a simple flap which permits the transport of material/air to the lance (and is therefore then opened), but it is automatically closed in the opposite direction by the reverse flow of material/gas.

The plastic agglomerates which are to be injected into the blast furnace have a tendency to cause blockages in the conduit 10 depending on their grain shape and size and also their specific composition, which should be prevented as described hereinbefore. If such a blockage (plug) occurs, a rapid blockage-removal operation must be effected. The shut-off block or unit is designed for that purpose. In the event of a blockage occurring, after closure of the shut-off valves (first and/or third shut-off device), a vent fitting or the vent valve 26 is opened. That venting action is effected by way of the outside atmosphere, with the consequence that a pressure drop of nearly 4 to 6 bars is to be recorded between the transport conduit 10 by way of the vent conduit 25 while the total pressure drop by way of the conduit from the injection fittings to the injection lance is only about 0.5 to 0.8 bar. Due to the extremely high air pressure drop, a considerable pressure is applied to the plastic material causing the blockage, and that results in the abrupt removal of blockages in the transport conduit so that the transport conduit is then again available, after closure of the valve 26. for injection of the agglomerated plastic materials.

What is claimed is:

1. A process for producing metal ores wherein the ore containing metal oxides is brought into contact with a reducing gas which contains at least one of carbon, hydrogen and compounds thereof obtained from solid carbon-bearing and/or hydrocarbon-bearing substances comprising:

injecting comminuted fluidized plastic material as an agglomerate into the air flow in the hearth of a metallurgical shaft furnace by way of lances (18) which are arranged in air nozzles of the metallurgical furnace, conveying the plastic material by way of a transport conduit (10) to the lances (18), providing the transport conduit (10) with a first shut-off device (24), a second shut-off device (28) and a third shut-off device (29), providing a means for coupling in compressed air to at least one of the transport conduit or the lance, closing the first shut-off device (24) when blockages of the plastic material in the transport conduit (10) or the lance (18) occur, closing the second shut-off device (28) when hot air penetrates by way of the injection lance (18) into the transport conduit (10) and/or the lance (18) in the opposite direction to the usual transport direction ($R_T$) and, closing the third shut-off device (29) when compressed air is supplied by way of the injection lance (18) for cooling.

2. A process according to claim 1, further comprising: providing a vent outlet (26) in the transport conduit (10) between the first and second shut-off devices and opening said vent opening (26) in the conduit (10) so that plastic material particles forming a blockage are discharged from the transport conduit (10) when the first shut-off device (24) blocks transportation of plastic material.

3. A process according to claim 1, wherein the second shut-off device (28) is a heat shut-off valve with the function of a check valve, said valve permitting the transporation of plastic material in the prescribed direction in the transport conduit and said valve closing when plastic material particles or gas are moved in the opposite direction to the prescribed transport direction.

4. A process according to claim 1, further comprising: activating the third shut-off device (29) when no plastic material is injected and simultaneously injecting compressed air for cooling the lance (18).

5. A process according to claim 1, further comprising: discharging the plastic material to be injected into the transport conduit from a plastic material reservoir by way of a lock assembly.

6. A process according to claim 1, further comprising: opening a vent in response to a blockage of transport of the plastic material, wherein opening said vent results in a pressure drop by way of the transport conduit to the metallurgical furnace of about 0.3 to 1 bar and a pressure difference between the interior of the transport conduit and the outer atmosphere of about 4 to 6 bars.

7. A process according to claim 1, wherein the plastic material is in the form of an agglomerate with a particle size of about 3 to 25 mm and a bulk density of greater than 0.25.

8. A process according to claim 1, wherein the injection pressure in the lances is $0.5\times10^5$ to $1.5\times10^5$ Pa above the pressure in the metalligical furnace.

9. A process according to claim 1, further comprising: successively fluidising and metering the plastic material particles in separate devices before introduction into the transport conduit.

10. A process according to claim 1, further comprising: fluidizing and metering the plastic material particles in a combined fluidizing and metering device and continuously adapting the injection pressure in dependence on the furnace pressure by way of a fast regulating loop (17).

11. A process according to claim 10, wherein the combined fluidizing and metering device is a pressure-tight cell-wheel lock assembly.

12. A process according to claim 1, that is for producing pig iron from iron ore.

13. A process according to claim 1, wherein the metallurgical furnace is a blast furnace.

* * * * *

UNITED STATES PATENT AND TRADEMARK OFFICE

CERTIFICATE OF CORRECTION

PATENT NO. : 6,231,638 B1
DATED : May 15, 2001
INVENTOR(S) : Joachim Janz et al.

It is certified that error appears in the above-identified patent and that said Letters Patent is hereby corrected as shown below:

Title page,
Item [73], Assignee, please correct to read as -- Der Grüne Punkt - Duales System Deutschland AG, Köln (DE) --.

Signed and Sealed this

Fifteenth Day of July, 2003

JAMES E. ROGAN
*Director of the United States Patent and Trademark Office*